US012078358B2

(12) United States Patent
Sousa

(10) Patent No.: US 12,078,358 B2
(45) Date of Patent: Sep. 3, 2024

(54) FIRE PIT

(71) Applicant: Jordan Kahn Company, Newton, MA (US)

(72) Inventor: Mark Sousa, Hope, RI (US)

( * ) Notice: Subject to any disclaimer, the term of this patent is extended or adjusted under 35 U.S.C. 154(b) by 403 days.

(21) Appl. No.: 17/574,315

(22) Filed: Jan. 12, 2022

(65) Prior Publication Data

US 2023/0221000 A1 Jul. 13, 2023

(51) Int. Cl.
*F24B 1/19* (2006.01)
*F24B 1/181* (2006.01)
*F24B 1/191* (2006.01)

(52) U.S. Cl.
CPC ..... *F24B 1/1915* (2013.01); *F24B 1/181* (2013.01)

(58) Field of Classification Search
CPC ..... F24B 1/181; F24B 13/006; F24B 1/191; F24B 1/1915; F24B 1/182; F24B 1/195
See application file for complete search history.

(56) References Cited

U.S. PATENT DOCUMENTS 1,279,033 A * 9/1918 Stollberg ..... F23G 5/42 110/259
5,836,298 A * 11/1998 Grady ..... F24B 1/181 126/506
11,092,342 B2 * 8/2021 Harrington ..... F24B 13/006
2003/0075166 A1 * 4/2003 Glass ..... F24B 1/181 126/506
2006/0225725 A1 * 10/2006 Rinaldo ..... A47J 37/0763 126/25 R
2014/0299005 A1 * 10/2014 Vinett ..... A23B 4/052 99/482
2019/0313851 A1 * 10/2019 Shemp ..... A47J 37/0718
2021/0018180 A1 * 1/2021 Jan ..... F24B 1/192
2021/0048188 A1 * 2/2021 Harrington ..... F24B 13/006

* cited by examiner

*Primary Examiner* — Alfred Basichas
(74) *Attorney, Agent, or Firm* — Frank Marino

(57) ABSTRACT

A fire pit has a tub with a hollow interior chamber for receiving ash-producing combustibles. The chamber has a perforated bottom portion. A support is adapted to attach to the tub and be removable therefrom without the use of tools. The support has an ash-collecting compartment disposed directly below the perforated bottom portion when the support is attached to the tub. The support is adapted to support the tub when attached thereto, and to receive hot ashes into the compartment which fall through the perforated bottom portion during combustion of the combustibles, so that the ashes can collect and cool within the compartment and then be transported with the removed support for remote disposal.

20 Claims, 6 Drawing Sheets

FIRE PIT

FIELD OF THE INVENTION

The present invention is related to outdoor fire pits. More specifically, this invention is related to an ash-collecting and removing arrangement therefore.

BACKGROUND

Fire pits are well known and often include a perforated open-topped sheet metal tub for receiving firewood and kindling. The firewood and kindling are ignited and air to aid combustion is drawn in through the perforations.

The sheet metal tubs are sometimes cylindrically shaped with a perforated sidewall and a flat bottom, or may be a semi-spherically shaped perforated shell with a rounded bottom.

Because the tub will become so hot during burning, it is critical to space it above the ground. So firepits are typically equipped with legs to lift the tub a few inches off the ground. Such legs are generally made of the same sheet metal as the tub itself, both for economy of manufacturing and for aesthetics.

The heat of the fire tends to weaken the sheet metal of the legs over time. Also, the fastened interface between the legs and the tubs tends to be prone to premature corrosion. And because a tub filled with firewood tends to be very heavy, such legs have been a source of failure for firepits. Long before the tub itself has failed, firepits are often found to be precariously supported by stones or such along with the one or two surviving feet, providing a very unstable and dangerous condition.

There is a need, and such is an object of the invention, to provide a more secure and reliable support structure for a fire pit tub which will not be prone to premature corrosion or heat-induced weakening.

Such leg systems also are permanently affixed to the tub and extend downwardly therefrom. This results in the need for more space during shipping and storing.

There is a need, and such is another object of the invention, to provide a support structure for a fire pit tub which is easily removable without the need for tools, and which may be shipped and stored within the tub in a manner that does not require more space that the tub itself.

As the wood burns in the fire pit's tub, it turns into ashes. The ashes typically fall to and collect on the floor of the tub. The ashes must be regularly removed or they will accumulate and block the tub's lower perforations, preventing combustion-enhancing air from flowing to and around the wood at the base of the fire. The ashes can also accumulate to the degree that they bury the wood at the base of the fire if not removed, preventing its combustion completely.

Some firepits include ash collecting drawers or such which collect ashes falling through one or more holes strategically positioned on the bottom of the tub. The drawer can be removed to allow for remote emptying. Such drawers are typically made to the same sheet metal and are prone to the same failures as sheet metal legs. When such drawers are not emptied regularly, the ashes, which are often still aglow, are prone to overflow the drawer and fall to the ground, creating another very dangerous situation. And when the drawer rusts through or sags it also allows the ashes to fall dangerously to the ground.

There is a need, and such is another object of the invention, to provide a more reliable arrangement for collecting ashes in a firepit which prevents accumulation in the tub and prevents dangerous ashes from falling to the ground even when not regularly emptied.

Further needs and objects exist which are addressed by the present invention, as may become apparent upon review of the included disclosure of exemplary embodiments thereof.

SUMMARY OF THE INVENTION

The invention may be embodied in or practiced using a fire pit having a support, or in the support itself, which is easily removable from the fire pit's tub without the need for tools, which is shaped and arranged to fit within the tub during shipping and storage, which is not prone to premature corrosion or heat-induced weakening, which includes an ash collecting and removal system which will not weaken or rust prematurely, and which prevents accumulation of ashes in the tub and prevents dangerous ashes from falling to the ground even when not regularly emptied.

The invention may also be embodied in or practiced using a fire pit with a tub having a hollow interior chamber adapted for receiving ash-producing combustibles and having a perforated bottom portion, and a support adapted to attach to the tub and be removable therefrom without the use of tools, and having an ash-collecting compartment disposed directly below the perforated bottom portion when the support is attached to the tub.

The support may be adapted both to support the tub when attached thereto, and to receive hot ashes into the compartment which fall through the perforated bottom portion during combustion of the combustibles, so that the ashes can collect and cool within the compartment and then be transported with the removed support for remote disposal.

The perforated bottom portion may prevent the combustibles from falling into the ash-collecting compartment while allowing ashes to fall into the ash-collecting compartment.

The tub may have a downwardly depending cylindrical ring surrounding the bottom portion, which fits rotatably within the ash collecting compartment. The downwardly depending cylindrical ring and the ash-collecting compartment may include mating fasteners to selectively secure the tub to the support. The mating fasteners may be pins extending from one of the downwardly depending cylindrical ring and the ash collecting compartment and slots affixed to the other of the downwardly depending cylindrical ring and the ash collecting compartment. The slots may be adapted to receive the pins and to secure the tub to the support during a first rotational relationship between the tub and the support, and the slots may be adapted to not receive the pins and to not secure the tub to the support during a second rotational relationship between the tub and the support. The pins may extend from the downwardly depending cylindrical ring and the slots may be affixed to the ash collecting compartment.

The tub may have a periphery with a shape and size and the support may have a footprint comprising approximately the shape and size. The first periphery and the footprint may be round and share a central axis. The secured tub and support may have a dimensional center and the secured support and tub in combination with an amount of combustibles sufficient to fill the interior chamber may cause a center of gravity which is below the dimensional center. The secured tub and support may have a height and the dimensional center may be vertically disposed approximately half of the height and may be horizontally disposed approximately on the central axis.

The invention may also be embodied in or practiced using an ash collecting and removing arrangement for an ash-producing appliance having a support adapted to attach to a tub of the appliance and be removable therefrom without the use of tools, and having an ash-collecting compartment disposed directly below a perforated bottom portion of the tub when the support is attached to the tub.

The support may be adapted both to support the tub when attached thereto, and to receive hot ashes into the compartment which fall through the perforated bottom portion during combustion of the combustibles, so that the ashes can collect and cool within the compartment and then be transported with the removed support for remote disposal.

The ash collecting compartment may be adapted to rotationally receive a cylindrical ring depending downwardly from the tub and surrounding the bottom portion.

The ash collecting compartment may have first fasteners adapted to selectively mate with second fasteners of the downwardly depending cylindrical ring to selectively secure the tub to the support. The first fasteners may be one of slots or pins affixed and the ash-collecting compartment adapted to selectively mate with the other of slots or pins affixed to the downwardly depending cylindrical ring. The slots may be adapted to receive the pins and to secure the tub to the support during a first rotational relationship between the tub and the support, and the slots may be adapted to not receive the pins and to not secure the tub to the support during a second rotational relationship between the tub and the support. The slots may be affixed to the ash collecting compartment.

The support may have a footprint approximating a shape and size of a periphery of the tub. The footprint may be round and share a central axis with the periphery. The secured tub and support may have a dimensional center. The secured support and tub in combination with an amount of combustibles sufficient to fill the interior chamber may cause a center of gravity which is below the dimensional center. The secured tub and support may have a height and the dimensional center may be vertically disposed approximately half of the height and may be horizontally disposed approximately on the central axis.

The invention may also be embodied in or practiced using the ash collecting and removing arrangement in combination with the tub.

Further features and aspects of the invention are disclosed with more specificity in the Detailed Description and accompanying drawings of an exemplary embodiment provided herein.

BRIEF DESCRIPTION OF THE DRAWINGS

Many aspects of the invention can be better understood with reference to the included Drawings showing an exemplary embodiment for practicing the invention which corresponds to the accompanying Detailed Description. The components in the Drawings are not necessarily to scale, emphasis instead being placed upon clearly illustrating the principles of the invention. Moreover, like reference numerals in the Drawings designate corresponding parts throughout the several views.

DETAILED DESCRIPTION OF AN EXEMPLARY EMBODIMENT

Figure 1:
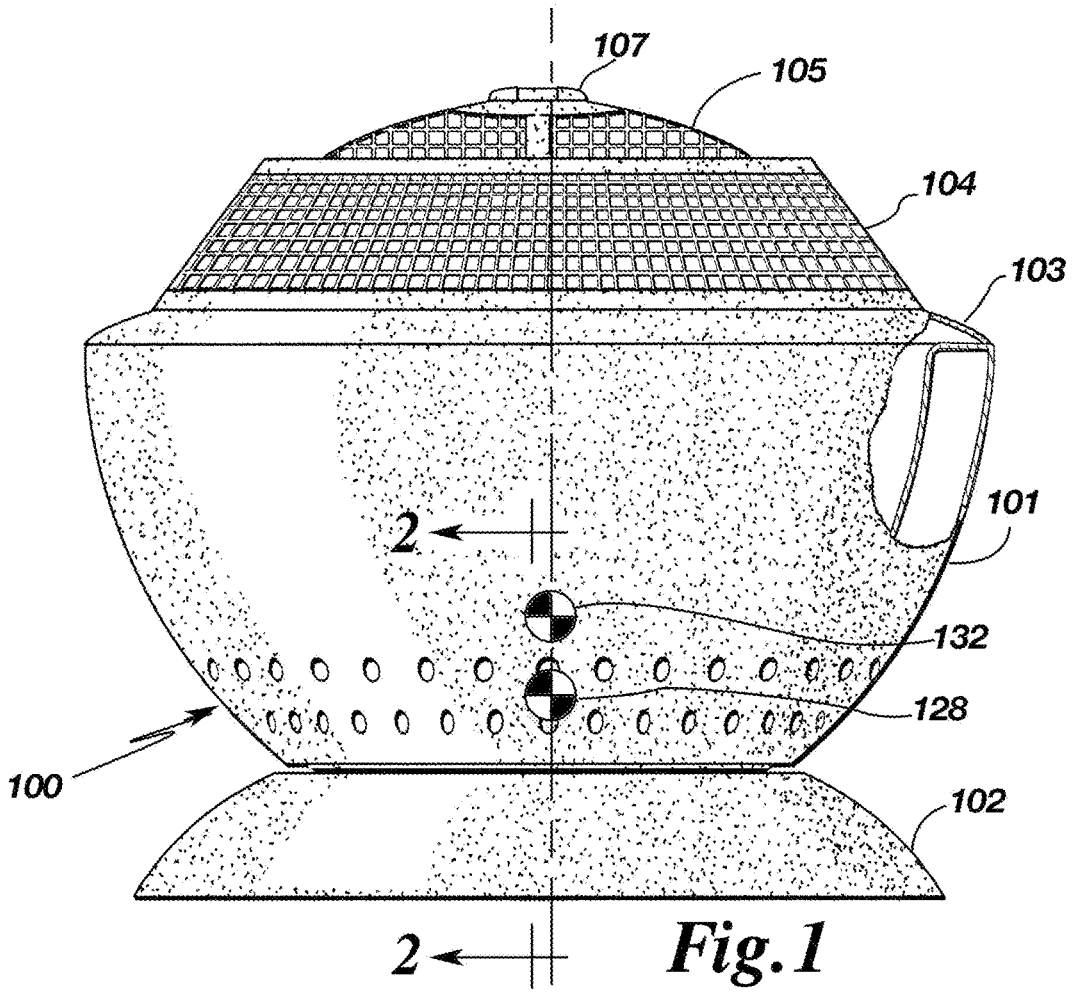
FIG. 1 is a front view of an exemplary fire pit having a support with an ash-collecting and removing arrangement according to or useful in practicing the invention.
Figure 2:
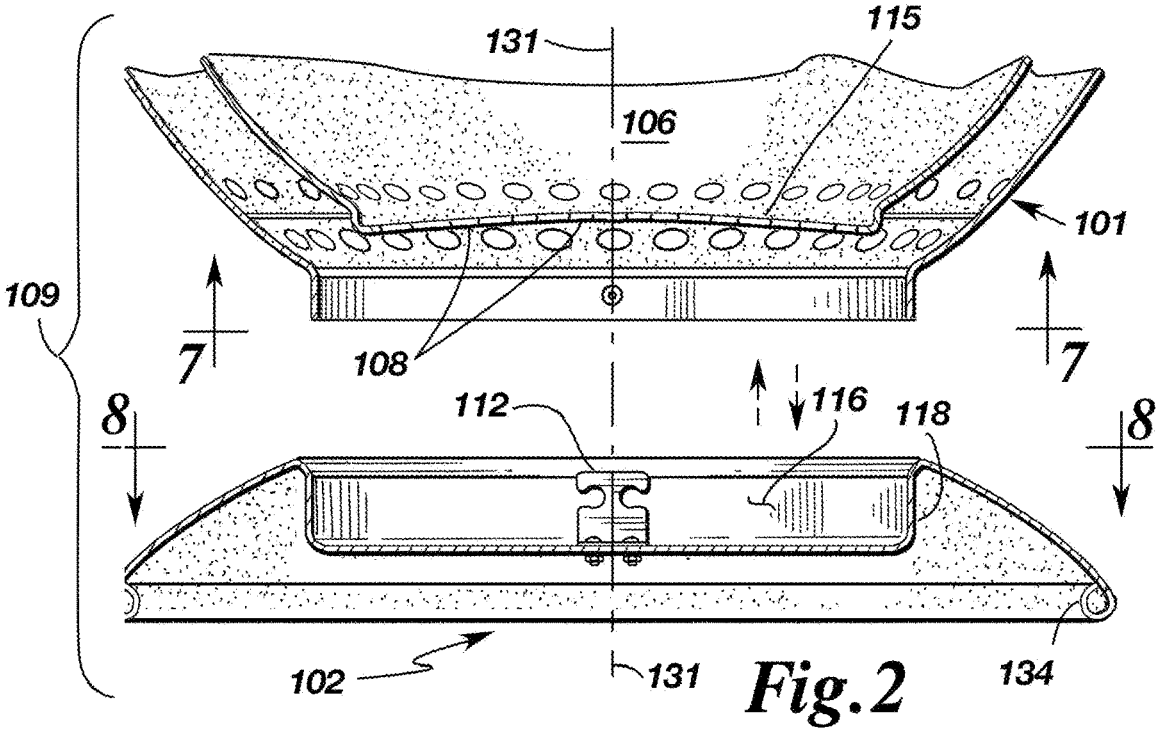
FIG. 2 is a disassembled partial cross-sectional view of the fire pit of FIG. 1 taken at line 2-2 of FIG. 1.
Figure 3:
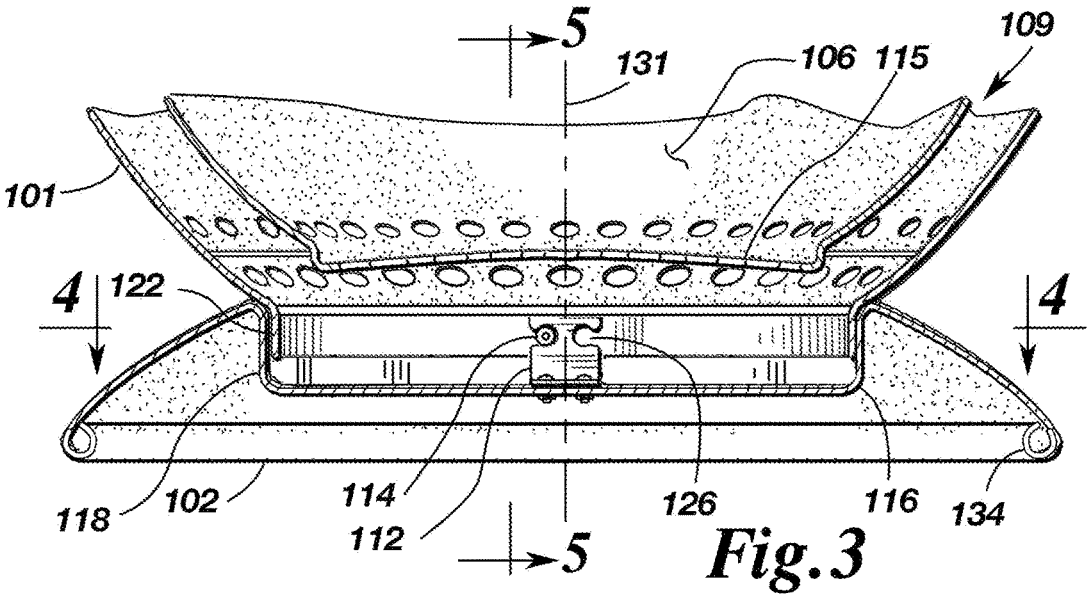
FIG. 3 is an assembled partial cross-sectional view of the fire pit of FIG. 1 taken at line 2-2 of FIG. 1.
Figure 4:
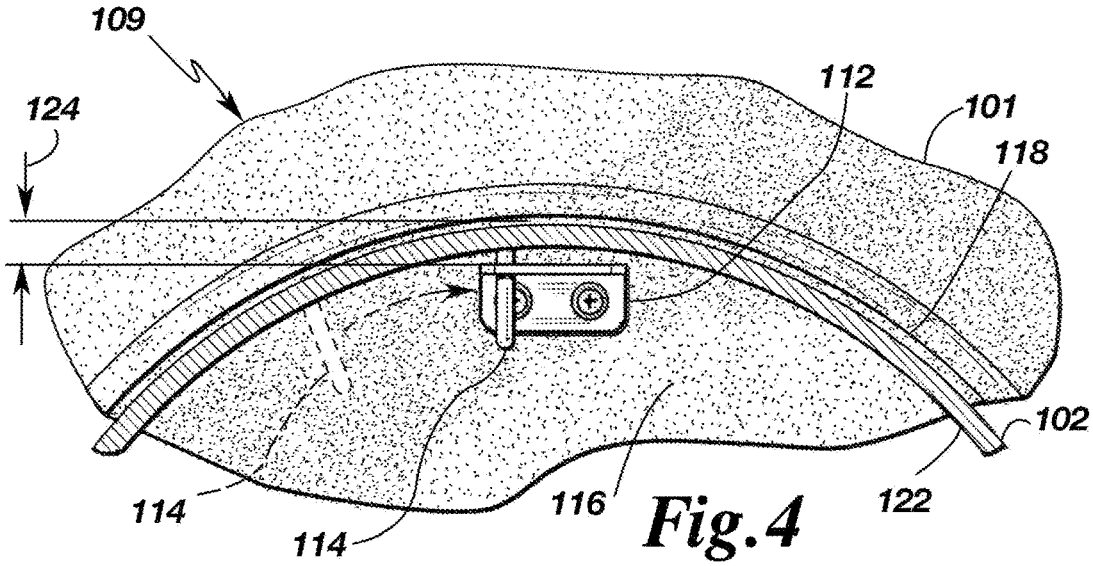
FIG. 4 is a partial cross-sectional view of the fire pit of FIG. 1 taken at line 4-4 of FIG. 3.
Figure 5:
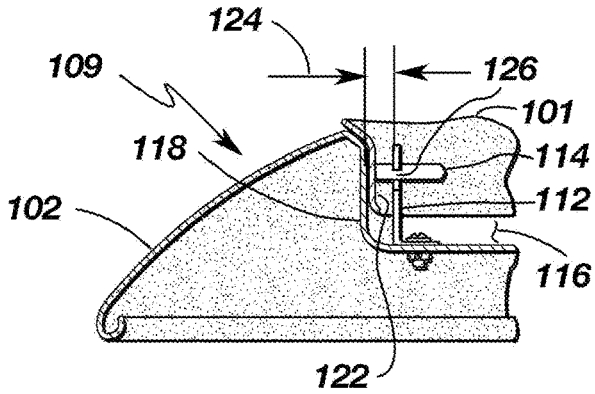
FIG. 5 is a partial cross-sectional view of the fire pit of FIG. 1 taken at line 5-5 of FIG. 3.
Figure 6:
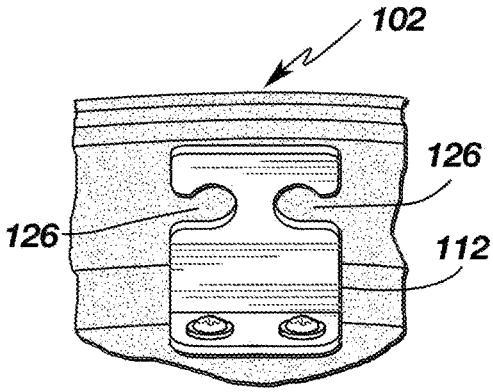
FIG. 6 is a close up view of the support-connecting arrangement of the fire pit of FIG. 1.
Figure 7:
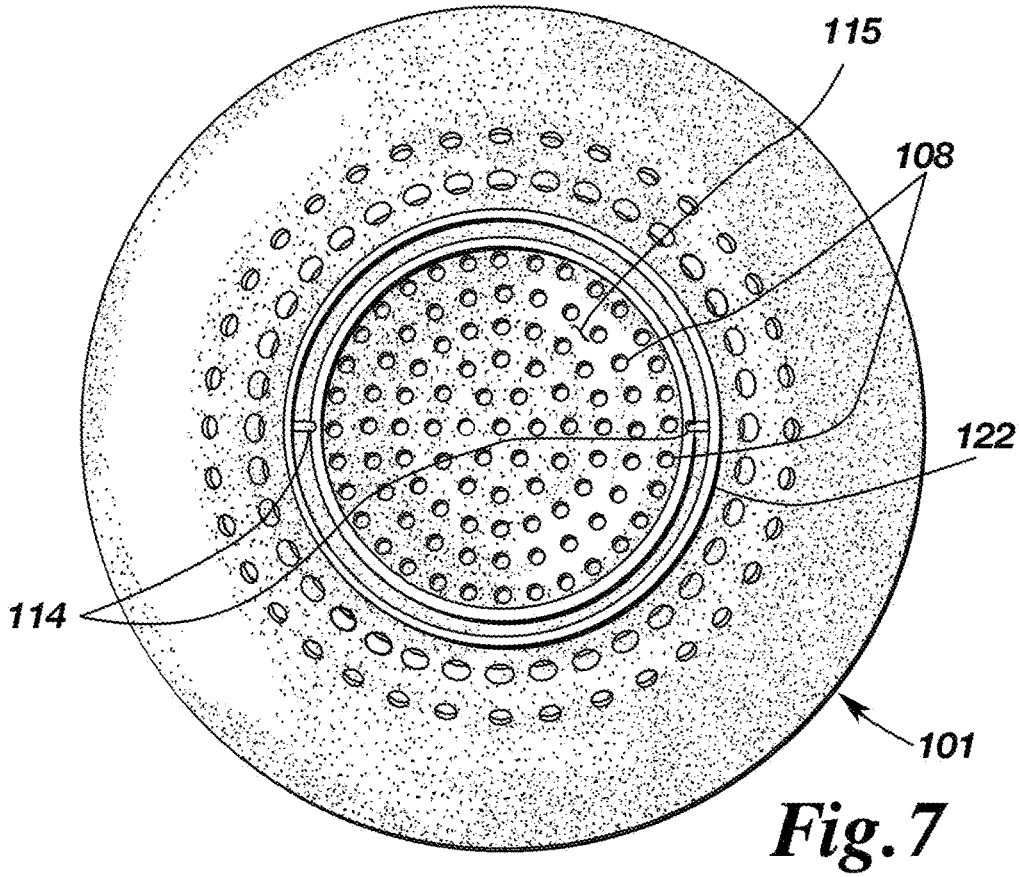
FIG. 7 is a bottom view of the tub of the fire pit of FIG. 1 taken at line 7-7 of FIG. 2.
Figure 8:
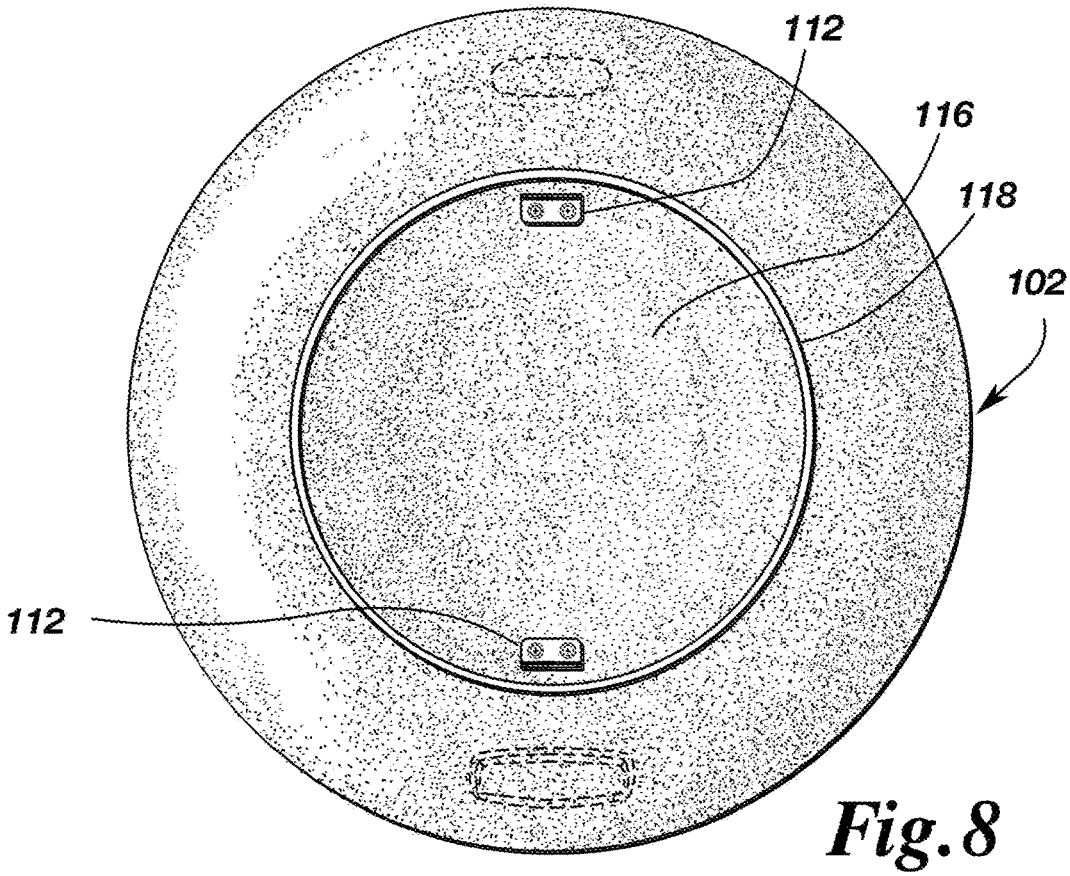
FIG. 8 is a top view of the support of the fire pit of FIG. 1 taken at line 8-8 of FIG. 2.
Figure 9:
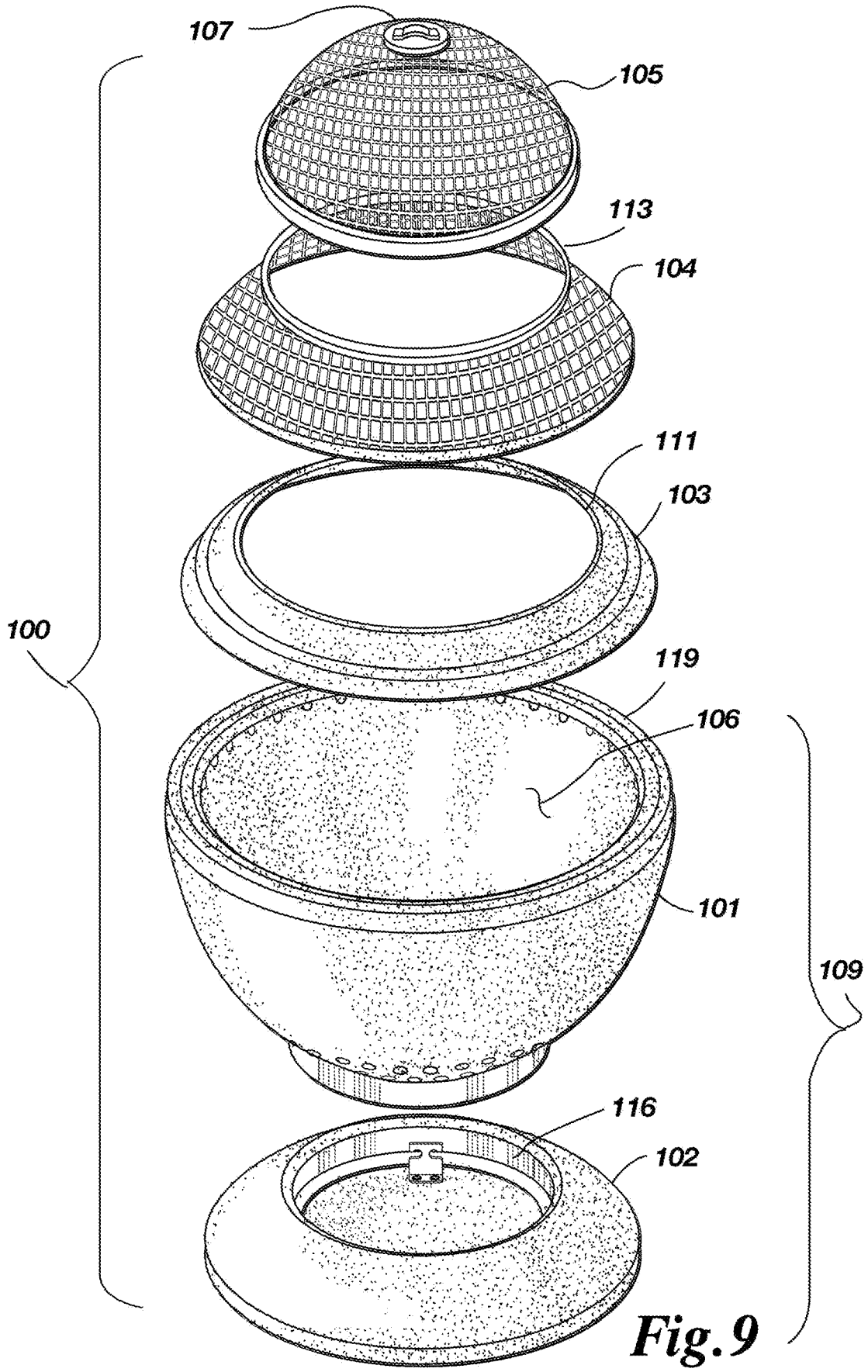
FIG. 9 is an exploded view of the fire pit of FIG. 1.

An exemplary fire pit 100 is shown in FIGS. 1 through 12, which includes tub 101, support 102, first collar 103, perforated second collar 104, and perforated lid 105. The tub, support, and first collar are all constructed of heavy gauge stainless steel sheet thirty thousandths of an inch thick, which is found sufficiently rigid for use and heavy enough to provide adequate stability. While thinner stainless steel sheet can lose its rust resistance when exposed to high temperature such as produced by burning firewood, this thick gauge is found adequate to maintain its rust resistance indefinitely. The lid and second collar are flame-arresting and constructed predominantly of screen or expanded sheet metal, with sufficiently-sized perforations to allow air or enter the tub while preventing flames and embers through. The lid includes handle 107 for removal and handling.

The support has an outer diameter of approximately twenty inches, approximately the same as the major diameter of the tub. The subassembly 109 of the tub and support has a height of approximately fifteen inches. This subassembly has a central vertical axis 131 equal to a shared imaginary vertical centerline of the tub and support. The subassembly has a dimensional center 132 horizontally located on the central axis and vertically located half (seven and one-half inches) of the fifteen inch height. This dimensional arrangement provides that the subassembly, when filled with a typical load of firewood 200 sufficient to fill the tub's hollow interior chamber 106, has a center of gravity 128 well below the dimensional center such that tip-over is prevented and stability is safely optimized.

It is anticipated and within the invention that such a stable arrangement may be provided in a fire pit of having any alternative outer shape than round, such oval, square, rectangular, hexagonal, octagonal, etc., provided that the footprint of the support approximates the shape and size of the periphery of the tub and the dimensional center has proportionately equivalent horizontal and vertical relationships to the center of gravity created.

The fire pit may be used without the collars and lid in the case where a more open "campfire" effect is desired, may be used with only the first collar when a more contained fire is desired, with both the first and send collars when a fire is desired with its embers and flames more contained, and with both collars and the lid when containment of any rising embers is desired and all flames are contained even at the expense of the otherwise-unobstructed view of the fire.

With the lid removed, the hollow interior chamber is adapted to receive ash-producing combustibles such as kindling and firewood 200 through the open top 113 of the second collar. With the lid and second collar removed, the hollow interior chamber is adapted to receive the ash-producing combustibles through the open top 111 of the first collar. And with the lid, second collar, and first collar removed, the hollow interior chamber is adapted to receive the ash-producing combustibles through the open top 119 of the tub.

The chamber has a perforated bottom portion 115. Holes 108 through the bottom portion are one-half inch in diameter. As best appreciated from FIG. 11, these holes are thus large enough to allow ashes 202 to fall from the bottom portion but small enough to prevent the combustibles from doing so. The support has an ash-collecting compartment 116 disposed directly below the perforated bottom portion when the support is attached to the tub.

As best seen in FIGS. 3 through 8, the support is adapted to attach to the tub and be removable therefrom without the use of tools by including a pair of oppositely disposed receivers 112 which are adapted to receive oppositely-disposed mating pins 114 of the tub. The compartment has a cylindrical outer wall 118, and the receivers are positioned a small distance inboard of the cylindrical outer wall leaving a space 124 there-between. The tub has a downwardly depending cylindrical ring 122 surrounding the bottom portion, which fits rotatably within the space and has the pins projecting inwardly therefrom. The pins are shaped and arranged to engage slots 126 of the receivers to prevent removal of the tub from the support.

The tub is lowered onto/into the support such that the cylindrical ring falls into the space with the pins rotated away from and unaligned with the receivers. The tub is then rotated until the pins are received within the slots of the receivers and the tub and support are thereby attached in a manner that aligns the ash-collecting compartment directly under the holes of the perforated bottom portion. The kindling and firewood are then placed within the chamber and ignited. Ashes produced therefrom fall through the holes and into the ash-collecting compartment.

The support is thereby adapted both to support the tub and to receive hot ashes into the compartment which fall through the perforated bottom portion during combustion of the combustibles, so that the ashes can collect and cool within the compartment. The support is also adapted to be a removable and portable mechanism for transporting the ashes for remote disposal.

The rolled bottom edge 134 of support is comfortable and reliable for handling during ash emptying, far more so than is a tub with legs.

This supporting and ash-collecting arrangement is equally useful for other ash-producing appliances such as, but not limited to; charcoal-burning, wood-burning or pellet-burning BBQ grills, charcoal-burning, wood-burning or pellet-burning griddles, and charcoal-burning, wood-burning or pellet-burning smokers.

Figure 10:
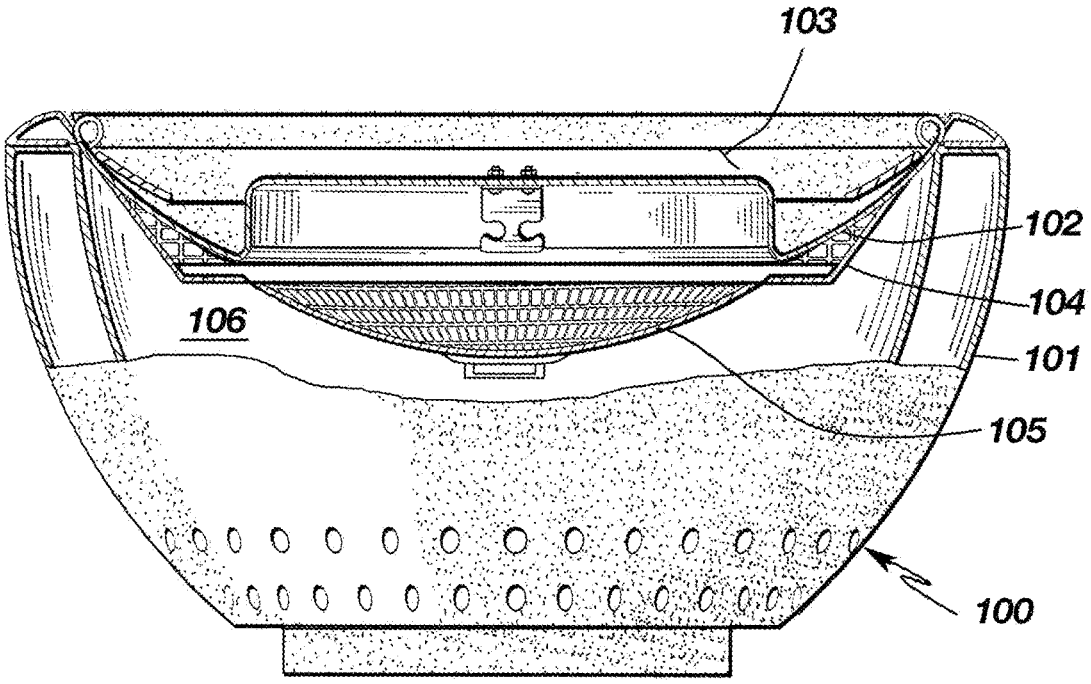
FIG. 10 is a break-away view showing the fire pit of FIG. 1 in its storage arrangement.

FIG. 10 shows how the components are shaped and sized to allow for their nesting into the tub for a more compacted its storage arrangement.

Figure 12:
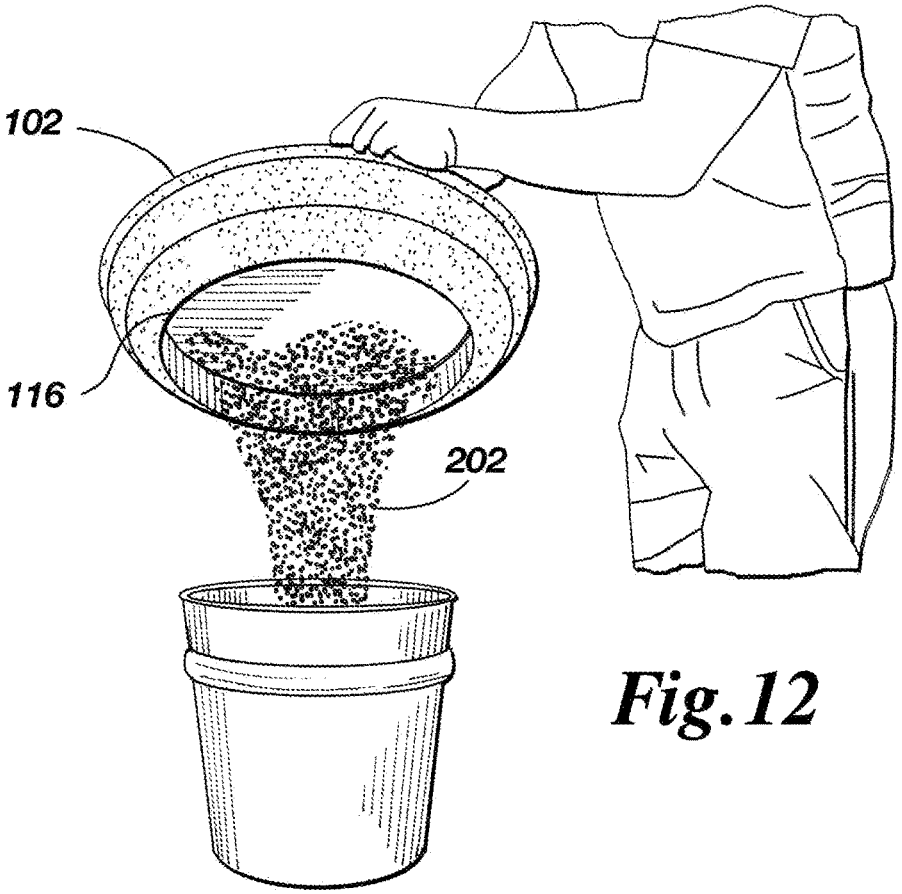
FIG. 12 is a view of the ash-collecting compartment of the fire pit of FIG. 1 being emptied.
Figure 11:
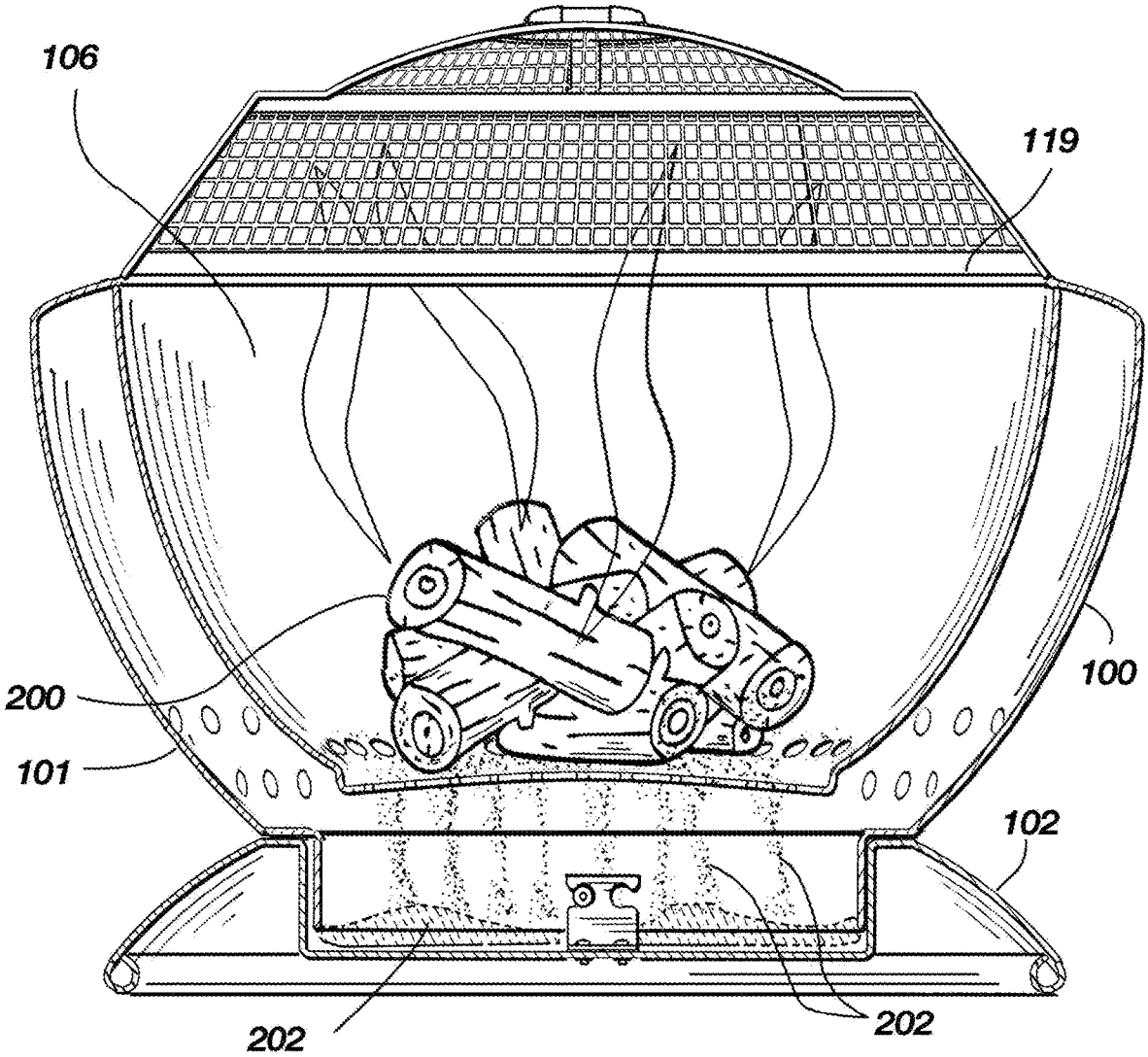
FIG. 11 is a cross-sectional view showing the fire pit of FIG. 1 during combustion and ash collection.

FIG. 11 shows the fire pit during combustion and ash collection, and FIG. 12 demonstrates the each with which the support can be taken to a convenient remote location for emptying the ashes that have accumulated in the ash-collecting compartment.

Various changes in form and detail may be made without departing from the spirit and scope of the invention, so the invention should therefore only be considered according to the following claims, including all equivalent interpretation to which they are entitled.

I claim:

1. A fire pit comprising:

a tub having interior and exterior walls separated by a gap;

the interior wall having a perforated bottom portion and perforated bottom panel, and forming a hollow interior chamber adapted for receiving ash-producing combustibles;

the exterior wall having an open bottom portion;

a support adapted to attach to the tub and be removable therefrom without the use of tools, and having an ash-collecting compartment disposed directly below and surrounding the open bottom portion of the exterior wall, the perforated bottom portion of the interior wall, and the perforated bottom panel of the interior wall when the support is attached to the tub;

wherein the support is adapted both to support the tub when attached thereto, and to receive hot ashes into the compartment which fall through the perforated bottom portion during combustion of the combustibles, so that the ashes can collect and cool within the compartment and then be transported with the removed support for remote disposal; and wherein the interior wall is non-perforated except for the perforated bottom portion and perforated bottom panel so that the hot ashes can only fall into the compartment through the perforated bottom portion of the interior wall, and the perforated bottom panel of the interior wall.

2. The fire pit of claim 1 wherein the perforated bottom portion and the perforated bottom panel prevent the combustibles from falling into the ash-collecting compartment while allowing ashes to fall into the ash-collecting compartment.

3. The fire pit of claim 2 wherein the tub comprises a downwardly depending cylindrical ring surrounding the bottom portion, which fits rotatably within the ash collecting compartment.

4. The fire pit of claim 3 wherein the downwardly depending cylindrical ring and the ash-collecting compartment comprise mating fasteners to selectively secure the tub to the support.

5. The fire pit of claim 4 wherein the mating fasteners comprise pins extending from one of the downwardly depending cylindrical ring and the ash collecting compartment and slots affixed to the other of the downwardly depending cylindrical ring and the ash collecting compartment, and wherein the slots are adapted to receive the pins and to secure the tub to the support during a first rotational relationship between the tub and the support, and the slots are adapted to not receive the pins and to not secure the tub to the support during a second rotational relationship between the tub and the support.

6. The fire pit of claim 5 wherein the pins extend from the downwardly depending cylindrical ring and the slots are affixed to the ash collecting compartment.

7. The fire pit of claim 6 wherein the tub has a periphery with a shape and size and the support has a footprint comprising approximately the shape and size.

8. The fire pit of claim 7 wherein the first periphery and the footprint are round and share a central axis.

9. The fire pit of claim 8 further comprising a dimensional center of the secured tub and support; wherein the secured support and tub in combination with an amount of combustibles sufficient to fill the interior chamber causes a center of gravity which is below the dimensional center.

10. The fire pit of claim 9 wherein the secured tub and support have a height and the dimensional center is vertically disposed approximately half of the height and is horizontally disposed approximately on the central axis.

11. An ash collecting and removing arrangement for an ash-producing appliance comprising:

a support adapted to attach to a tub of the appliance and be removable therefrom without the use of tools, and having an ash-collecting compartment disposed directly below a perforated bottom portion and a perforated bottom panel of the tub when the support is attached to the tub;

wherein the support is adapted both to support the tub when attached thereto, and to receive hot ashes into the compartment which fall through the perforated bottom portion during combustion of the combustibles, so that the ashes can collect and cool within the compartment and then be transported with the removed support for remote disposal; and wherein tub is interiorly non-perforated except for the perforated bottom portion and perforated bottom panel and the ash-collecting compartment is disposed directly below and surrounds the perforated bottom portion and perforated bottom panel when the support is attached to the tub such that the hot ashes can only fall into the compartment through the perforated bottom portion of the interior wall, and the perforated bottom panel of the interior wall.

12. The ash collecting and removing arrangement of claim 11 wherein the ash collecting compartment is adapted to rotationally receive a cylindrical ring depending downwardly from the tub and surrounding the bottom portion.

13. The ash collecting and removing arrangement of claim 12 wherein the ash collecting compartment comprises first fasteners adapted to selectively mate with second fasteners of the downwardly depending cylindrical ring to selectively secure the tub to the support.

14. The ash collecting and removing arrangement of claim 13 wherein the first fasteners comprise one of slots or pins affixed and the ash-collecting compartment adapted to selectively mate with the other of slots or pins affixed to the downwardly depending cylindrical ring and wherein the slots are adapted to receive the pins and to secure the tub to the support during a first rotational relationship between the tub and the support, and the slots are adapted to not receive the pins and to not secure the tub to the support during a second rotational relationship between the tub and the support.

15. The ash collecting and removing arrangement of claim 14 wherein the slots are affixed to the ash collecting compartment.

16. The ash collecting and removing arrangement of claim 15 wherein the support has a footprint approximating a shape and size of a periphery of the tub.

17. The ash collecting and removing arrangement of claim 16 wherein the footprint is round and shares a central axis with the periphery.

18. The ash collecting and removing arrangement of claim 17 further comprising a dimensional center of the secured tub and support; wherein the secured support and tub in combination with an amount of combustibles sufficient to fill the interior chamber causes a center of gravity which is below the dimensional center.

19. The ash collecting and removing arrangement of claim 18 wherein the secured tub and support have a height and the dimensional center is vertically disposed approximately half of the height and is horizontally disposed approximately on the central axis.

20. The ash collecting and removing arrangement of claim 19 in combination with the tub.

* * * * *